US009511966B2

(12) United States Patent
Kawashima

(10) Patent No.: US 9,511,966 B2
(45) Date of Patent: Dec. 6, 2016

(54) SHEET CONVEYING DEVICE AND IMAGE FORMING APPARATUS INCLUDING THE SAME

(71) Applicant: KYOCERA Document Solutions Inc., Osaka-shi, Osaka (JP)

(72) Inventor: Tetsuro Kawashima, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/493,162

(22) Filed: Sep. 22, 2014

(65) Prior Publication Data

US 2015/0084265 A1 Mar. 26, 2015

(30) Foreign Application Priority Data

Sep. 25, 2013 (JP) ..... 2013-198868

(51) Int. Cl.

| | |
|---|---|
| ***B65H 29/52*** | (2006.01) |
| ***B65H 29/14*** | (2006.01) |
| ***B65H 29/70*** | (2006.01) |
| ***B65H 7/20*** | (2006.01) |
| ***B65H 29/12*** | (2006.01) |
| ***B65H 85/00*** | (2006.01) |

(52) U.S. Cl.

CPC ..... *B65H 7/20* (2013.01); *B65H 29/125* (2013.01); *B65H 29/14* (2013.01); *B65H 29/52* (2013.01); *B65H 29/70* (2013.01); *B65H 85/00* (2013.01); *B65H 2301/33312* (2013.01); *B65H 2301/51214* (2013.01); *B65H 2404/611* (2013.01); *B65H 2601/251* (2013.01); *B65H 2801/06* (2013.01)

(58) Field of Classification Search

CPC ..... B65H 29/52; B65H 29/70; B65H 29/58; B65H 29/60; B65H 5/068; B65H 2301/33312; B65H 29/14; B65H 29/145; B65H 5/38

See application file for complete search history.

(56) References Cited

U.S. PATENT DOCUMENTS

| | | | | |
|---|---|---|---|---|
| 6,328,303 | B1 | 12/2001 | Maetani | |
| 8,439,357 | B2 * | 5/2013 | Arikawa et al. | 271/184 |
| 2004/0256790 | A1 * | 12/2004 | Saito et al. | 271/186 |
| 2006/0062619 | A1 * | 3/2006 | Tanjo | 399/401 |
| 2009/0108518 | A1 * | 4/2009 | Kawashima | 271/225 |
| 2012/0201564 | A1 | 8/2012 | Masuda | |
| 2013/0301089 | A1 * | 11/2013 | Arikawa et al. | 358/498 |

FOREIGN PATENT DOCUMENTS

| | | | |
|---|---|---|---|
| JP | 3059052 | U | 7/1999 |
| JP | 11217144 | A | 8/1999 |
| JP | 2006056664 | A | 3/2006 |
| JP | 2011090170 | A | 5/2011 |
| WO | 2011049204 | A1 | 4/2011 |

* cited by examiner

*Primary Examiner* — Luis A Gonzalez

(74) *Attorney, Agent, or Firm* — Alleman Hall McCoy Russell & Tuttle LLP

(57) ABSTRACT

A sheet conveying device is provided in a sheet discharge portion of an image forming apparatus. A curved path and a reverse conveyance path are formed within the sheet conveying device. An outer guide rib and an inner guide rib are provided to a conveyance guide forming a lower-side guide surface of the curved path. The inner guide rib is lower than a reference straight line connecting a pressure contact point of a discharge roller pair to a rotary roller, and the outer guide rib is higher than the reference straight line.

8 Claims, 7 Drawing Sheets

SHEET CONVEYING DEVICE AND IMAGE FORMING APPARATUS INCLUDING THE SAME

INCORPORATION BY REFERENCE

This application is based upon and claims the benefit of priority from the corresponding Japanese Patent Application No. 2013-198868 filed on Sep. 25, 2013, the entire contents of which are incorporated herein by reference.

BACKGROUND

The present disclosure relates to a sheet conveying device that conveys a sheet member, and particularly relates to a sheet conveying device having a conveyance path for reversing a sheet member guided to a sheet discharge port and returning the sheet member to an image forming portion again, and an image forming apparatus including the sheet conveying device.

A typical image forming apparatus such as a copy machine, a printer, or the like has a reverse conveyance path used for forming images on both sides of a sheet member (print sheet). In the reverse conveyance path, a sheet member having an image formed on one side thereof is reversed and guided again to an image formation position at which an image is formed by an image forming portion. As the reverse conveyance path, for example, a path is known which branches from a discharge path extending from the image formation position to a sheet discharge port and extends from the branch point to a merging point that is at the upstream side of the image formation position in a conveying direction. The reversing of the sheet member is performed by the following method. Specifically, when an image has been formed on one side of a sheet member, the sheet member is sent to the discharge path. Then, when the rear end of the sheet member has passed through the branch point, conveyance of the sheet member being conveyed toward the sheet discharge port is stopped. Then, the sheet member is conveyed in the reverse direction (reversely conveyed) toward the branch point. Reversing the conveying direction and conveying the sheet member as described above is referred to as switch-back conveyance or reverse conveyance. The sheet member that has been switched back to be conveyed is guided to the reverse conveyance path by a guide member such as a flap. When the sheet member has been returned to an image transfer position via the reverse conveyance path, the reversing of the sheet member is completed. It should be noted that a method is also known in which a guide member such as a flap is not provided and a sheet member is introduced from the branch point to the reverse conveyance path owing to only stiffness of the sheet member.

SUMMARY

A sheet conveying device according to one aspect of the present disclosure includes a first conveyance path, a second conveyance path, a third conveyance path, a merging portion, and a discharge roller pair. The first conveyance path is configured to guide a sheet member from a sheet storage portion to an image forming portion. The second conveyance path is formed at a downstream side of the first conveyance path in a conveying direction of the sheet member and configured to guide the sheet member having an image formed thereon by the image forming portion, to a sheet discharge port. One end of the third conveyance path is connected to the first conveyance path and the other end is connected to the second conveyance path and the third conveyance path is configured to reverse the sheet member guided to the sheet discharge port and guide the sheet member to the image forming portion. The merging portion is a portion at which the second conveyance path and the third conveyance path merge with each other. The discharge roller pair is provided near the sheet discharge port so as to be rotatable forward and reversely and is configured to nip the sheet member and convey the sheet member from the sheet discharge port either in a discharge direction or in a reverse direction. The second conveyance path includes a conveyance guide provided with a guide rib that projects upward from a guide surface thereof and extends along the conveying direction of the sheet member. A plurality of the guide ribs are provided in a width direction perpendicular to the conveying direction of the sheet member, and an outer guide rib provided outward of the discharge roller pair in the width direction is formed in a shape higher than an inner guide rib provided inward in the width direction.

An image forming apparatus according to another aspect of the present disclosure includes the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
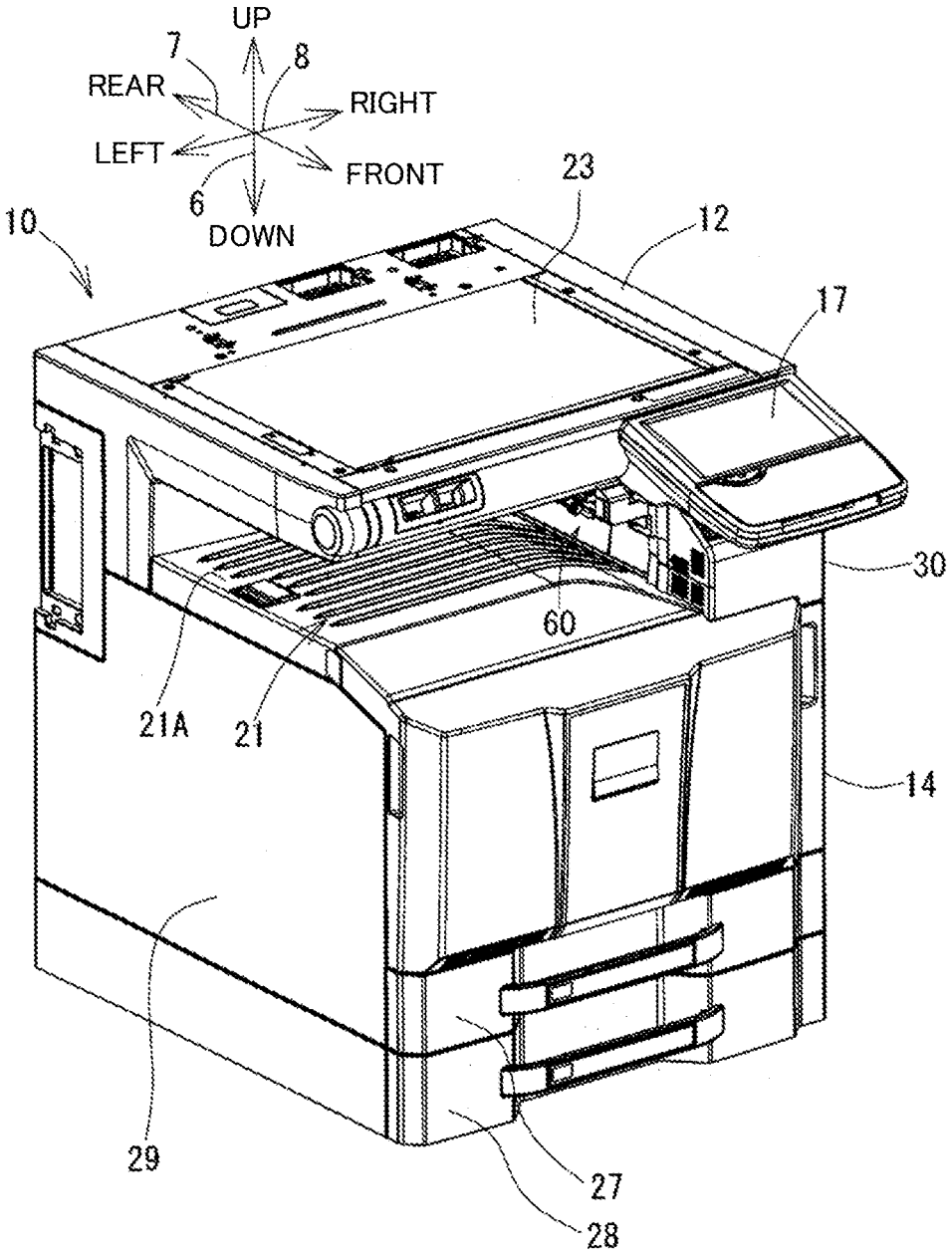
FIG. 1 is a perspective view showing an image forming apparatus according to an embodiment of the present disclosure.

Hereinafter, a sheet conveying device 60 and an image forming apparatus 10 including the sheet conveying device 60 according to an embodiment of the present disclosure will be described with reference to the drawings. It should be noted that, for convenience of explanation, in a state where the image forming apparatus 10 is installed on a flat plane (a state shown in FIG. 1), the vertical direction is defined as an up-down direction 6. In addition, a front-rear direction 7 is defined with, as a front face (front surface), a surface at a side at which an operation display panel 17 is provided. Moreover, a right-left direction 8 is defined based on the front face of the image forming apparatus 10. It should be noted that the following embodiment is merely an example in which the present disclosure is embodied, and therefore does not limit the technical scope of the present disclosure.

Figure 2:
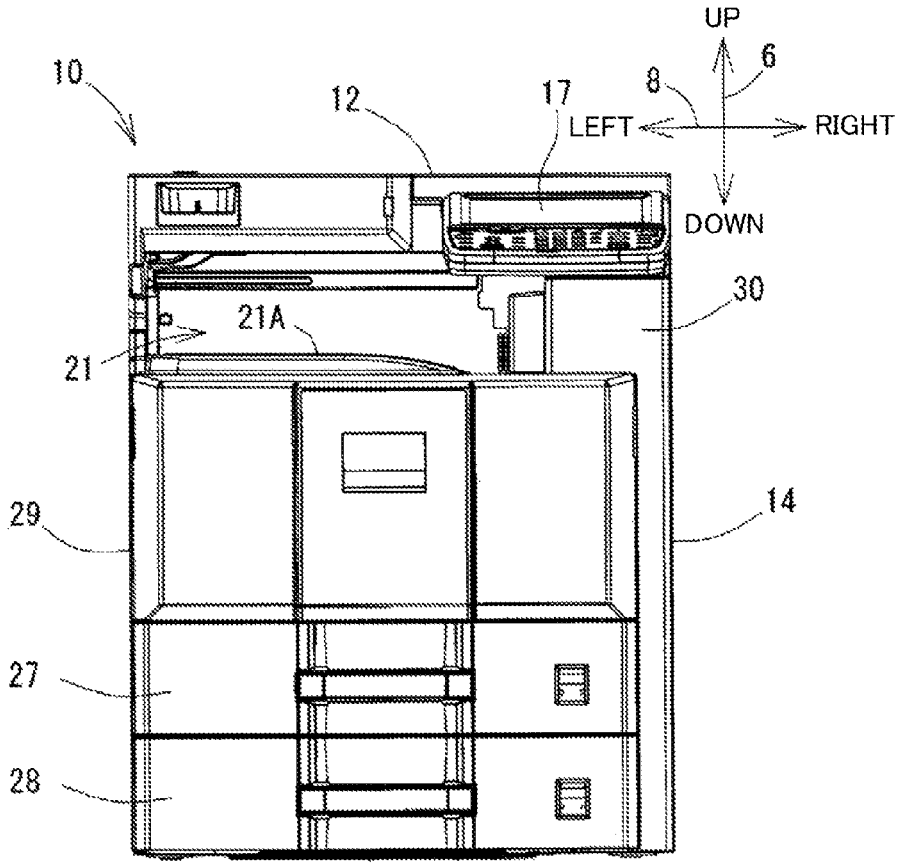
FIG. 2 is a front view showing a front face of the image forming apparatus in FIG. 1.

First, a schematic configuration of the image forming apparatus 10 will be described with reference to FIGS. 1 to 3. As shown in FIG. 1, the image forming apparatus 10 is a multifunction peripheral referred to as a so-called in-body discharge type, and has functions of a printer, a copying machine, a FAX apparatus, a scanner, and the like. The image forming apparatus 10 forms an inputted image on a print sheet P (an example of a sheet member of the present disclosure) by using a printing material such as toner. It should be noted that the image forming apparatus 10 is not limited to the multifunction peripheral, and the present disclosure is applicable even when the image forming apparatus 10 is a dedicated machine such as a printer, a copying machine, a FAX apparatus, or the like.

The image forming apparatus 10 includes an image reading portion 12 and an image forming portion 14. The image reading portion 12 performs a process of reading an image on a document, and is provided at an upper portion of the image forming apparatus 10. The image forming portion 14 performs a process of forming an image on the basis of an electrophotographic method, and is provided below the image reading portion 12. In addition, the image forming portion 14 includes two sheet feeders 27 and 28 arranged vertically at two stages. The sheet feeder 27 at the upper side is provided at a lowermost portion of the image forming portion 14 so as to be integrated with a housing 29. The sheet feeder 28 at the lower side is of an extension type connected as an option device to the bottom of the housing 29 of the image forming portion 14. The sheet feeder 28 is configured to be attachable to and detachable from the bottom of the housing 29. In addition, a sheet discharge portion 30 is provided at the right side of the image forming portion 14. It should be noted that the image forming portion 14 is not limited to an electrophotographic type, and may be an inkjet recording type or may be another recording type or another print type.

A sheet discharge space 21 to which a print sheet P is discharged is provided above the image forming portion 14. The sheet discharge portion 30 is provided so as to connect the image forming portion 14 to the image reading portion 12 while forming the sheet discharge space 21 between the image forming portion 14 and the image reading portion 12. As shown in FIG. 1, the front side and the left side of the sheet discharge space 21 are opened. In addition, the rear side and the right side of the sheet discharge space 21 are not opened, the rear side thereof is closed, and the sheet discharge portion 30 is provided at the right side thereof. A sheet discharge tray 21A that holds the discharged print sheet P is provided in the sheet discharge space 21. In the present embodiment, the sheet conveying device 60 is provided within the sheet discharge portion 30.

As shown in FIG. 1, the image reading portion 12 includes a document placement table 23. When the image forming apparatus 10 functions as a copying machine, a document is set on the document placement table 23, and a document cover 24 is closed. Then, a copy start instruction is inputted through the operation display panel 17. Accordingly, a reading operation by the image reading portion 12 is started, and image data of the document is read. Then, the read image data is sent to the image forming portion 14. In FIGS. 1 and 2, the document cover 24 (see FIG. 3) of the image reading portion 12 is not shown.

Figure 3:
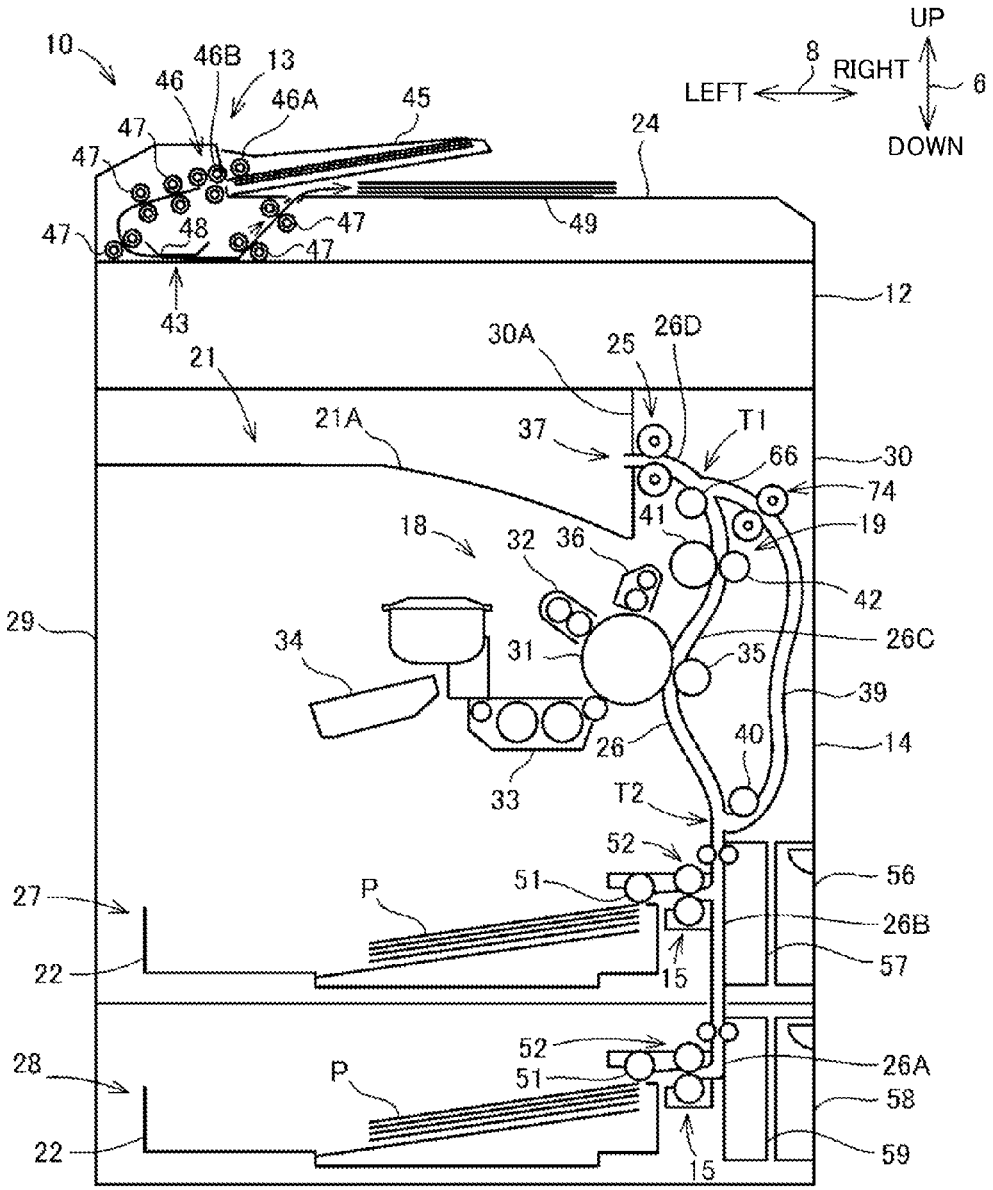
FIG. 3 is a schematic diagram showing an internal configuration of the image forming apparatus in FIG. 1.

In addition, as shown in FIG. 3, the image reading portion 12 includes an ADF 13. The ADF 13 is provided in the document cover 24. The ADF 13 is an automatic document feeder and includes a document tray 45, a feeding mechanism 46, a plurality of conveying rollers 47, a sheet holder 48, a sheet discharge portion 49, and the like. The ADF 13 conveys a document set on the document tray 45 through a reading position 43 on the document placement table 23 to the sheet discharge portion 49 by driving the feeding mechanism 46 and each conveying roller 47 with a motor (not shown). The feeding mechanism 46 includes: a feed roller 46A that takes out a document; and a conveying roller 46B that conveys the document taken out by the feed roller 46A. The document is fed from the document tray 45 by the feed roller 46A and conveyed to the downstream side in a feeding direction by the conveying roller 46B. Then, the document is further conveyed by the conveying rollers 47 provided at the downstream side in the feeding direction. In the course of conveying the document by the ADF 13, an image on the document passing through the reading position 43 is read by the image reading portion 12.

The image forming portion 14 forms an image on a print sheet P of a specified size such as A size or B size on the basis of image data read by the image reading portion 12 or externally inputted image data. In the present embodiment, in accordance with a preset print mode (one-side printing mode or double-sided printing mode), the image forming portion 14 performs either a one-side printing process (one-side image forming process) of forming an image on only one side of a print sheet P or a double-sided printing process (double-sided image forming process) of forming images on both sides of a print sheet P. When the one-side printing process is performed, as described later, the image forming portion 14 discharges a print sheet P having an image formed on one side thereof to the sheet discharge tray 21A of the sheet discharge space 21. On the other hand, when the double-sided printing process is performed, as described later, the image forming portion 14 switches back a print sheet P having an image formed on one side thereof, then sends the print sheet P to a later-described reverse conveyance path 39, forms an image again on the back surface of the print sheet P, and subsequently discharges the print sheet P having the images formed on both sides thereof to the sheet discharge tray 21A of the sheet discharge space 21.

As shown in FIG. 3, the image forming portion 14 mainly includes the sheet feeders 27 and 28, an electrophotographic type image transfer portion 18, a fixing portion 19, the sheet conveying device 60, a control portion (not shown) that comprehensively controls the image forming portion 14, and the like. In other words, the image forming apparatus 10 includes the sheet conveying device 60. In addition, the image forming portion 14 includes a conveyance motor and a discharge motor (both are not shown). These components are provided within the housing 29 that forms a cover of an outer frame and an inner frame of the image forming portion 14 and the like.

The sheet feeders 27 and 28 each convey a sheet member toward the image transfer portion 18. Each of the sheet feeders 27 and 28 includes a tray-shaped paper sheet storage portion 22 (an example of a sheet storage portion of the present disclosure) and a feeding mechanism 15. Print sheets P on which images are to be formed by the image transfer portion 18 (print sheets P used for image formation) are placed in the paper sheet storage portion 22. The feeding mechanism 15 takes out and conveys the print sheets P stored in the paper sheet storage portion 22 one by one. The feeding mechanism 15 is provided at the upper side of a right end portion of the paper sheet storage portion 22. The feeding mechanism 15 includes a feed roller 51 and a conveying roller pair 52 including a pair of rollers. When an instruction for feeding the print sheet P is inputted to the image forming apparatus 10, the conveyance motor is rotationally driven. Accordingly, the feed roller 51 and the conveying roller pair 52 are rotated. Then, the print sheet P is fed from the paper sheet storage portion 22 by the feed roller 51 and conveyed to the downstream side in a feeding direction of the print sheet P by the conveying roller pair 52.

As shown in FIG. 3, in the image forming portion 14, a main conveyance path 26 is formed so as to extend upward from the conveying roller pair 52. The main conveyance path 26 is formed at the right side surface side of the housing 29 and extends in the up-down direction 6 along the right side surface. In the following, a description will be given with the main conveyance path 26 divided into four sections, namely, a first section 26A, a second section 26B, a third section 26C, and a fourth section 26D. The first section 26A is formed at the sheet feeder 28. The second section 26B is formed at the sheet feeder 27. The third section 26C is a section extending from a later-described merging point T2 near the end of the second section 26B to the fixing portion 19. The fourth section 26D is a section extending from an exit of the fixing portion 19 through a later-described branch point T1 to a paper sheet discharge port 37. The print sheet P having passed through the fixing portion 19 is guided to the paper sheet discharge port 37 by the fourth section 26D. It should be noted that the third section 26C is an example of a first conveyance path of the present disclosure. In addition, the fourth section 26D is an example of a second conveyance path of the present disclosure.

The sheet feeder 27 includes an outer cover 56 and an inner cover 57. The outer cover 56 and the inner cover 57 are provided at a right side end portion of the sheet feeder 27. When the outer cover 56 is opened in an open direction from a closed attitude shown in FIG. 3, the inner cover 57 is opened in the same direction in conjunction with the opening motion of the outer cover 56. Accordingly, the second section 26B at the sheet feeder 27 is opened. It should be noted that an outer cover 58 and an inner cover 59 having the same configuration as that of the sheet feeder 27 are provided also in the sheet feeder 28.

The image transfer portion 18 is provided above the sheet feeder 27. The image transfer portion 18 performs an image transfer process on the print sheet P transferred from each of the sheet feeders 27 and 28. Specifically, on the basis of inputted image data, the image transfer portion 18 transfers a toner image to the print sheet P by using a printing material such as toner. As shown in FIG. 3, the image transfer portion 18 includes a photosensitive drum 31, a charging portion 32, a developing portion 33, an LSU (Laser Scanning Unit) 34, a transfer roller 35, and a cleaning portion 36.

The photosensitive drum 31 is provided at the left side of the third section 26C. When an image forming operation is started, the surface of the photosensitive drum 31 is charged at a uniform potential by the charging portion 32. In addition, the LSU 34 scans the photosensitive drum 31 with laser light corresponding to image data. Accordingly, an electrostatic latent image is formed on the photosensitive drum 31. Then, toner is attached to the electrostatic latent image by the developing portion 33, whereby a toner image is formed on the photosensitive drum 31. The transfer roller 35 is provided at the right side of the third section 26C and disposed so as to face the photosensitive drum 31 across the third section 26C. When the print sheet P passing through the third section 26C passes through a nip portion of the transfer roller 35 and the photosensitive drum 31, the toner image is transferred onto the print sheet P by the transfer roller 35. The print sheet P on which the toner image has been transferred is conveyed through the third section 26C to the fixing portion 19 that is disposed at the downstream side of the image transfer portion 18 in a conveying direction of the print sheet P (i.e., at the upper side thereof).

The fixing portion 19 fixes the toner image transferred onto the print sheet P, on the print sheet P with heat. The fixing portion 19 includes a heating roller 41 and a pressure roller 42. The pressure roller 42 is urged toward the heating roller 41 side by an elastic member such as a spring. Accordingly, the pressure roller 42 is brought into pressure contact with the heating roller 41. The heating roller 41 is heated to high temperature by a heating device 41A (see FIG. 4) such as a heater during the fixing operation. While the print sheet P passes through the fixing portion 19, the toner forming the toner image is heated to melt by the heating roller 41, and further the print sheet P is pressed by the pressure roller 42. As a result, the toner is fixed on the print sheet P by the fixing portion 19. In other words, the toner image is fixed on the print sheet P, whereby an image is formed on the print sheet P. The print sheet P on which the fixation has been performed is conveyed by the respective rollers 41 and 42 of the fixing portion 19 to the fourth section 26D extending from the fixing portion 19 to the later-described paper sheet discharge port 37.

Figure 4:
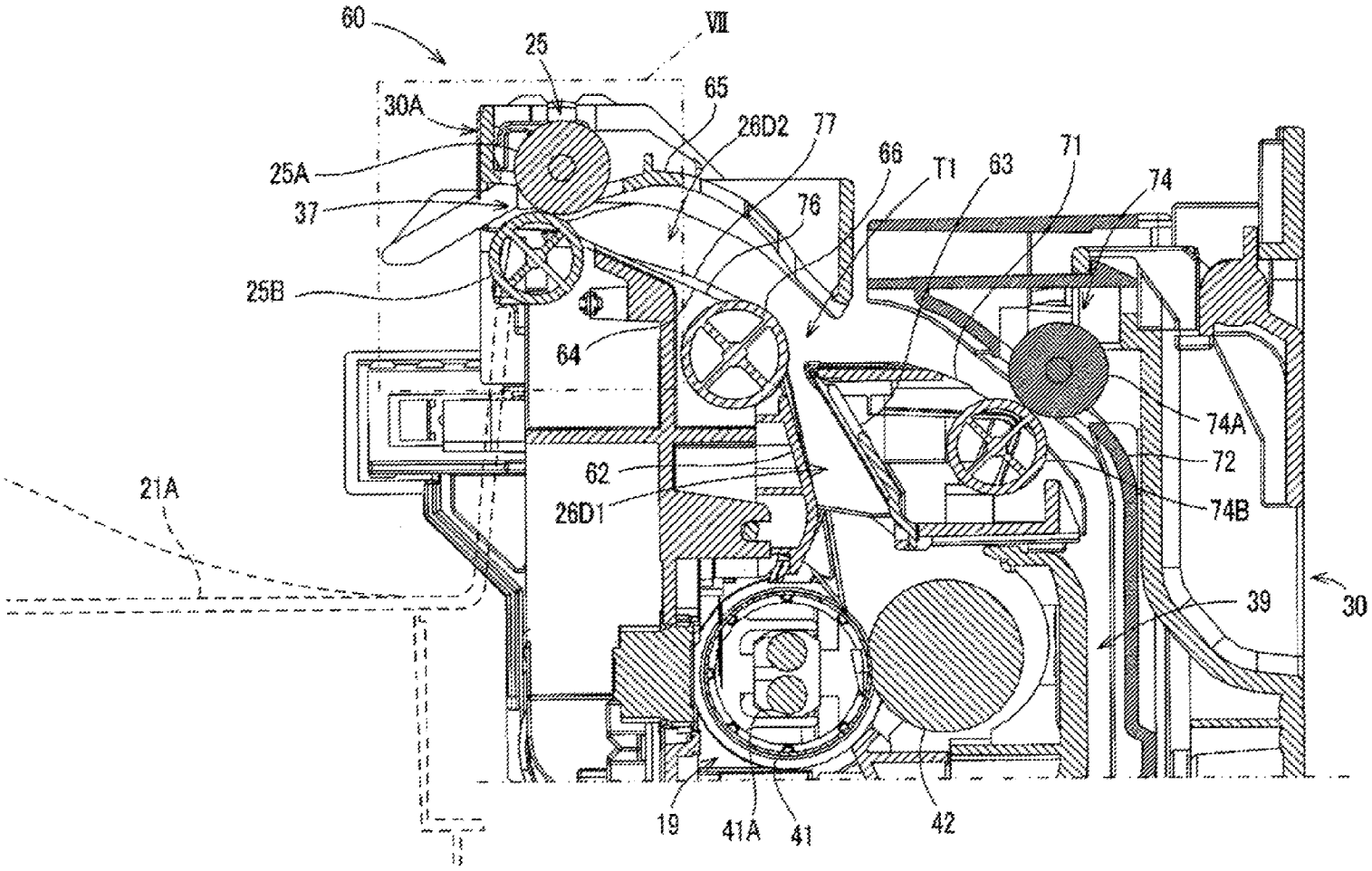
FIG. 4 is a cross-sectional view showing a peripheral configuration of a sheet conveying device of the image forming apparatus in FIG. 1.

The sheet conveying device 60 is provided at the upper side of the fixing portion 19. As shown in FIG. 4, the sheet conveying device 60 includes conveyance guides 62 to 65, discharge roller pairs 25 (an example of a discharge roller pair of the present disclosure), and rotary rollers 66 (an example of a rotator of the present disclosure).

As shown in FIG. 3, the paper sheet discharge port 37 through which the print sheet P is discharged is formed at the end of the fourth section 26D of the main conveyance path 26. The paper sheet discharge port 37 is an opening provided in a left side surface 30A of the sheet discharge portion 30. The left side surface 30A of the sheet discharge portion 30 is a vertical surface generally extending in the up-down direction 6. The paper sheet discharge port 37 is exposed from the left side surface 30A to the sheet discharge space 21.

The fourth section 26D is a conveyance path for guiding the print sheet P having an image fixed thereon by the fixing portion 19, to the paper sheet discharge port 37, and is formed as a section extending from a downstream-side exit of the fixing portion 19 to the paper sheet discharge port 37. The fourth section 26D is formed in a curved shape so as to extend upward in the vertical direction from the fixing portion 19 and then be curved near the branch point T1 that is in the middle of the fourth section 26D, toward the paper sheet discharge port 37. The fourth section 26D is formed by a plurality of the conveyance guides 62 to 65 (see FIG. 4).

As shown in FIG. 4, the conveyance guides 62 and 63 are provided so as to extend along a straight path 26D1 of the fourth section 26D (see FIG. 3) which straight path 26D1 extends from the fixing portion 19 to the branch point T1. In other words, the conveyance guides 62 and 63 are provided at the upstream side of the branch point T1 in the conveying direction of the print sheet P. The conveyance guides 62 and 63 extend from the fixing portion 19 to the branch point T1 generally along the up-down direction 6. The straight path 26D1 is formed by the conveyance guides 62 and 63. The conveyance guide 62 is an example of an upstream-side guide portion of the present disclosure and is provided at the left side of the straight path 26D1, namely, at the heating roller 41 side thereof. A left-side guide surface of the straight path 26D1 is formed by the conveyance guide 62. In addition, the conveyance guide 63 is provided at the right side of the straight path 26D1, namely, at the pressure roller 42 side thereof. A right-side guide surface of the straight path 26D1 is formed by the conveyance guide 63.

The conveyance guides 64 and 65 are provided so as to extend along a curved path 26D2 of the fourth section 26D which curved path 26D2 extends from the branch point T1 to the paper sheet discharge port 37. The curved path 26D2 is formed by the conveyance guides 64 and 65. The conveyance guide 64 is an example of a downstream-side guide portion of the present disclosure and is provided at the lower side of the curved path 26D2. The conveyance guide 64 is connected to the conveyance guide 62 near the branch point T1. The conveyance guide 64 is gently inclined from the branch point T1 toward the paper sheet discharge port 37. A lower-side guide surface 64A of the curved path 26D2 is formed by the conveyance guide 64. In addition, the conveyance guide 65 is provided at the upper side of the curved path 26D2. An upper-side guide surface of the curved path 26D2 is formed by the conveyance guide 65. In a state where the conveyance guide 64 and the conveyance guide 62 are connected to each other, a guide surface from the guide surface of the conveyance guide 62 to the guide surface 64A of the conveyance guide 64 has a curved shape. It should be noted that a conveyance guide of the present disclosure is realized by the conveyance guides 62 and 64.

Each discharge roller pair 25 is provided near the paper sheet discharge port 37. Each discharge roller pair 25 is a roller pair including a driving roller 25A and a driven roller 25B that are brought into pressure contact with each other. An elastic member having a high sliding friction like rubber is attached on the roller surface of the driving roller 25A. The driving roller 25A is rotatably supported at the upper side of the curved path 26D2. Specifically, the driving roller 25A is supported about an axis by the conveyance guide 65. A rotational driving force in a forward or reverse direction is transmitted from the discharge motor (not shown) to the driving roller 25A. Thus, the driving roller 25A is rotatable in a rotation direction corresponding to the inputted rotational driving force. The driven roller 25B is rotatably supported at the lower side of the curved path 26D2. Specifically, the driven roller 25B is provided at the paper sheet discharge port 37 side of the conveyance guide 64. The driven roller 25B is supported about an axis by the conveyance guide 64. The driven roller 25B is urged toward the driving roller 25A side by an elastic member (not shown) such a coil spring. Accordingly, the driven roller 25B is always brought into pressure contact with the surface of the driving roller 25A by an appropriate elastic urging force. Therefore, when the driving roller 25A is rotationally driven, the driven roller 25B is also driven so as to follow the rotation of the driving roller 25A due to the contact friction.

Figure 5:
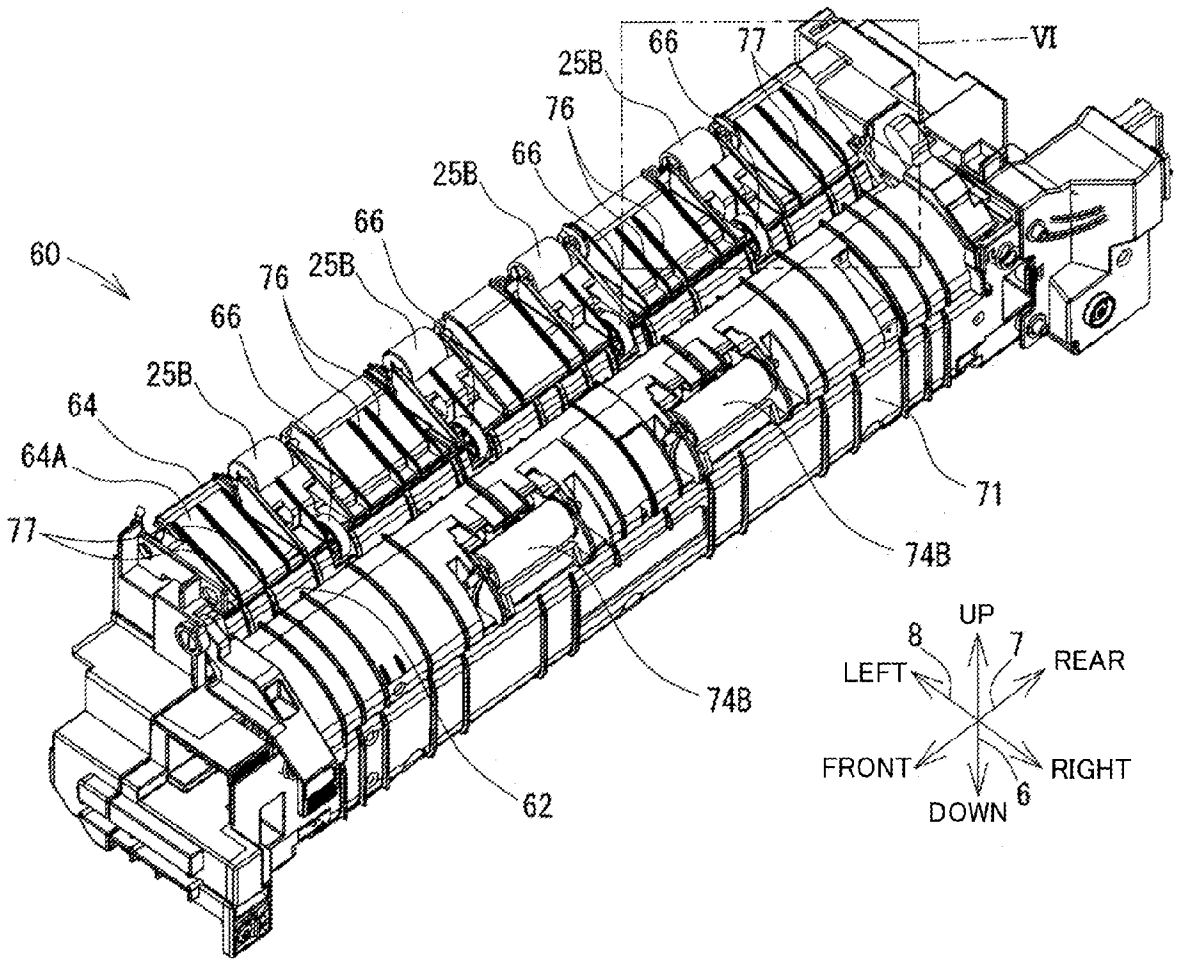
FIG. 5 is a perspective view showing conveyance guides of the sheet conveying device in FIG. 4.

In the present embodiment, as shown in FIG. 5, four discharge roller pairs 25 are provided along the front-rear direction 7 (corresponding to a width direction of the present disclosure) so as to be spaced apart from each other at predetermined intervals. It should be noted that in FIG. 5, the conveyance guide 65 at the upper side is not shown, and thus the driving rollers 25A at the upper side are not shown. By the rotation direction of the discharge motor (not shown) being controlled, each of the four discharge roller pairs 25 nips the print sheet P at a nip portion that is a pressure contact point at which the driving roller 25A and the driven roller 25B are brought into pressure contact with each other, and conveys the print sheet P either in a discharge direction from the paper sheet discharge port 37 toward the sheet discharge space 21 or in a reverse direction toward the later-described reverse conveyance path 39. For example, the print sheet P conveyed to the fourth section 26D through the fixing portion 19 is conveyed in the discharge direction toward the paper sheet discharge port 37 by the discharge roller pair 25 that is rotated in a forward rotation direction by the discharge motor. In addition, the print sheet P is conveyed in the reverse direction toward the reverse conveyance path 39 by the discharge roller pair 25 that is rotated in a reverse rotation direction by the discharge motor.

The rotary rollers 66 are rotatably provided at the conveyance guide 64 forming the lower-side guide surface 64A of the curved path 26D2. Each rotary roller 66 has a smaller size in the width direction than that of each of the respective rollers 25A and 25B of each discharge roller pair 25. The rotary rollers 66 are provided at the branch point T1 side of the conveyance guide 64. The roller surface of each rotary roller 66 is exposed in the fourth section 26D and near the branch point T1. In other words, the roller surface of each rotary roller 66 is exposed from the guide surface 64A of the conveyance guide 64 to the fourth section 26D side. Thus, when the print sheet P passes through the fourth section 26D, the roller surface of each rotary roller 66 contacts the print sheet P. In other words, each rotary roller 66 contacts an image formation surface of the print sheet P passing through the branch point T1. Specifically, each rotary roller 66 contacts the print sheet P at a position spaced apart from the conveyance guide 64 by the length from the conveyance guide 64 to the roller surface thereof. By contacting the print sheet P moving in the fourth section 26D toward the paper sheet discharge port 37, each rotary roller 66 rotates due to the contact friction thereof.

In the present embodiment, as shown in FIG. 5, four rotary rollers 66 are provided along the front-rear direction 7 so as to be spaced apart from each other at predetermined intervals. Specifically, the rotary rollers 66 are provided at positions where the rotary rollers 66 overlap parts of the four discharge roller pairs 25, respectively, in the width direction when being seen from the upstream side or the downstream side in the conveying direction of the print sheet P which coincides with the right-left direction 8.

When a one-side printing process is performed in the image forming portion 14, the print sheet P having a toner image transferred onto one side thereof by the image transfer portion 18 passes through the fixing portion 19, then moves in the fourth section 26D, and is discharged through the paper sheet discharge port 37 to the outside by the respective four discharge roller pairs 25.

On the other hand, when a double-sided printing process is performed in the image forming portion 14, the print sheet P having an image formed initially on one side thereof passes through the fixing portion 19, is sent to the fourth section 26D, then is reversely conveyed in the fourth section 26D, and is sent to the reverse conveyance path 39. Specifically, in a state where the leading end, in the discharge direction, of the print sheet P having the image formed on the one side thereof is exposed from the paper sheet discharge port 37 to the outside, the discharge roller pairs 25 are stopped. At that time, the rear end, in the discharge direction, of the print sheet P is held in a state of being nipped by the discharge roller pairs 25. Then, the discharge roller pairs 25 are rotated in the reverse rotation direction by reverse rotational driving of the discharge motor (not shown). Accordingly, the print sheet P is conveyed in the fourth section 26D again in the reverse direction. In other words, the print sheet P is reversely conveyed (switched back to be conveyed) in the fourth section 26D.

As shown in FIG. 3, in the sheet conveying device 60, the reverse conveyance path 39 (an example of a third conveyance path of the present disclosure) is formed so as to branch from the branch point T1 which is in the middle of the fourth section 26D. In other words, the fourth section 26D and the reverse conveyance path 39 merge with each other at the branch point T1 (corresponding to a merging portion of the present disclosure). In performing a double-sided printing process, the print sheet P conveyed reversely in the fourth section 26D enters into the reverse conveyance path 39 through the branch point T1. The reverse conveyance path 39 is formed so as to branch from the branch point T1, extend diagonally right-downward in a curved manner, and then extend linearly downward in the vertical direction. The lower end side of the reverse conveyance path 39 merges with the third section 26C at the merging point T2 at the upstream of the image transfer portion 18 in the conveying direction of the print sheet P. In other words, the reverse conveyance path 39 extends from the branch point T1 to the merging point T2. The reverse conveyance path 39 is formed within the image forming portion 14 and at the right side of the main conveyance path 26. The reverse conveyance path 39 extends in the up-down direction 6 (vertical direction) so as to be generally parallel to the main conveyance path 26.

As shown in FIG. 4, a plurality of conveyance guides 71 to 73 (an example of a second conveyance guide of the present disclosure) are provided within the image forming portion 14. Each of the conveyance guides 71 to 73 is provided so as to extend along the reverse conveyance path 39. In other words, the reverse conveyance path 39 is formed by the plurality of conveyance guides 71 to 73. Specifically, the conveyance guide 71 is provided at the left side of the reverse conveyance path 39, namely, the main conveyance path 26 side thereof. A left-side guide surface of the reverse conveyance path 39 is formed by the conveyance guide 71. In addition, the conveyance guide 72 is provided at the right side of the reverse conveyance path 39. A right-side guide surface of the reverse conveyance path 39 is formed by the conveyance guide 72. It should be noted that the conveyance guide 72 may be provided to the housing 29, or may be formed by an inner surface of an openable/closable cover member that opens a right side surface of the image forming portion 14.

Conveying roller pairs 74 are provided on the curved portion of the reverse conveyance path 39 at the upper side thereof. Each conveying roller pair 74 is a roller pair including a driving roller 74A and a driven roller 74B that are brought into pressure contact with each other. An elastic member having a high sliding friction like rubber is attached on the roller surface of the driving roller 74A. The driving roller 74A is rotatably supported by the conveyance guide 72. In addition, the driven roller 74B is rotatably supported by the conveyance guide 71. In the present embodiment, as shown in FIG. 5, two conveying roller pairs 74 are provided near the center in the front-rear direction 7 so as to be spaced apart from each other. When a rotational driving force in the reverse rotation direction is inputted from the discharge motor to each driving roller 74A, each conveying roller pair 74 conveys the print sheet P having entered into the reverse conveyance path 39 from the branch point T1, in a direction toward the merging point T2. It should be noted that in FIG. 5, the conveyance guide 72 is not shown, and thus the driving rollers 74A are also not shown.

In the configuration in which the fourth section 26D and the reverse conveyance path 39 are formed as described above, in performing a double-sided printing process, the print sheet P conveyed reversely in the curved path 26D2 of the fourth section 26D does not enter into the straight path 26D1 but enters into the reverse conveyance path 39 due to the stiffness thereof and momentum in which the print sheet P is conveyed in the reverse direction. However, when a print sheet P having a width larger than the arrangement interval between the two outer discharge roller pairs 25 of the four discharge roller pairs 25 is reversely conveyed, sheet end portions located further outward of the two outer discharge roller pairs 25 in the front-rear direction 7 (width direction) may hang down. This hanging-down occurs since the sheet end portions are not nipped by the discharge roller pairs 25. In other words, since the sheet end portions are not nipped by the discharge roller pairs 25, the hanging-down occurs due to a force in the direction of gravity caused by the weights of the sheet end portions. Particularly, when a thin print sheet that is less stiff and has a large size is conveyed, the hanging-down is great. In the case where the print sheet P is reversely conveyed while the sheet end portions thereof hang down, when the print sheet P conveyed reversely along the conveyance guide 64 passes through the branch point T1, the sheet end portions thereof enter into the straight path 26D1. Due to this, the sheet end portions are bent or broken, which may cause the print sheet P to be jammed at the branch point T1.

In the present embodiment, in order to eliminate the problem of bending due to the hanging-down and smoothly convey the print sheet to the reverse conveyance path 39, inner guide ribs 76 and outer guide ribs 77 having different heights are provided on the guide surface 64A of the conveyance guide 64. These guide ribs 76 and 77 are formed so as to be integrated with the conveyance guide 64. As shown in FIG. 5, each of the guide ribs 76 and 77 is a projection that projects upward from the guide surface 64A of the conveyance guide 64, extends in the conveying direction of the print sheet P in the curved path 26D2, and has a long plate shape with a small width. In other words, each of the guide ribs 76 and 77 extends in a direction in which the print sheet P is guided by the conveyance guides 64 and 65.

Figure 7:
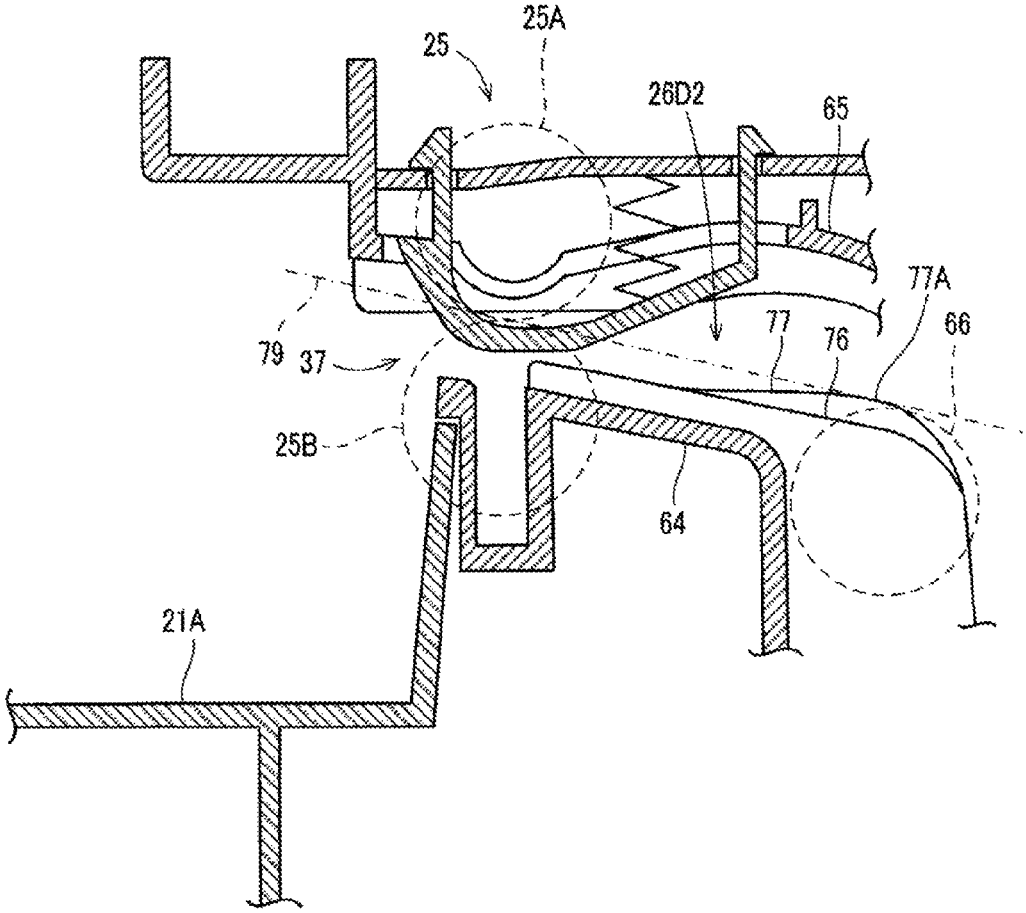
FIG. 7 is a schematic diagram showing a configuration in a principal part VII in FIG. 4.

Specifically, a plurality of inner guide ribs 76 are formed inward of the discharge roller pairs 25 in the front-rear direction 7 (width direction). Specifically, the plurality of inner guide ribs 76 are formed inward of the two discharge roller pairs 25 located at both sides in the width direction, of the four discharge roller pairs 25. The respective inner guide ribs 76 are formed with the same height. In the present embodiment, as shown in FIG. 7, each inner guide rib 76 is formed in a shape lower than a reference straight line 79 connecting the nip portion of the driving roller 25A and the driven roller 25B of the discharge roller pair 25 and the outer circumferential surface of the rotary roller 66 that is a contact point of the rotary roller 66 with the print sheet P.

Figure 6:
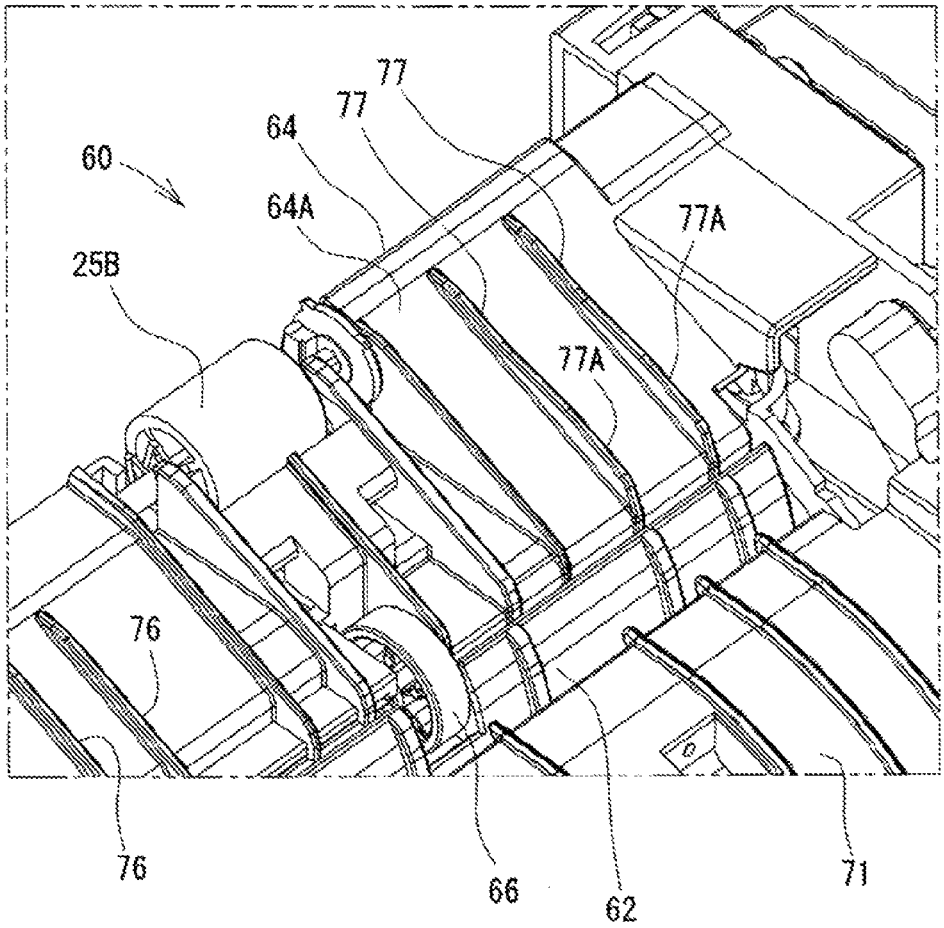
FIG. 6 is an enlarged view of a principal part VI in FIG. 5.

In addition, a plurality of outer guide ribs 77 are formed outward of the discharge roller pairs 25 in the front-rear direction 7 (width direction). The plurality of guide ribs 77 are formed outward of the two discharge roller pairs 25 located at both sides in the width direction. Two outer guide ribs 77 are formed at each of both sides, in the width direction, of the conveyance guide 64. Each outer guide rib 77 is formed in a shape higher than each inner guide rib 76. As shown in FIG. 6, specifically, each outer guide rib 77 is formed in such a shape that an end portion thereof at the paper sheet discharge port 37 side is formed with generally the same height as that of each inner guide rib 76 and the height thereof is gradually increased toward the branch point T1 side. A half portion 77A of each outer guide rib 77 at the branch point T1 side is formed so as to be higher than each inner guide rib 76. In the present embodiment, as shown in FIG. 7, the portion 77A of each outer guide rib 77 is formed in a shape with the same height as the reference straight line 79.

Since the inner guide ribs 76 and the outer guide ribs 77 are provided to the conveyance guide 64 as described above, when the print sheet P is conveyed in the curved path 26D2 in the discharge direction in a state where an image fixation surface thereof faces the conveyance guide 64 after an image is fixed thereon by the fixing portion 19, each rotary roller 66 contacts the image fixation surface. Thereafter, the print sheet P is conveyed in the discharge direction while the image fixation surface thereof is supported by each rotary roller 66. Then, when the print sheet P is further conveyed in the discharge direction and nipped by each discharge roller pair 25, the print sheet P is supported by the nip portion of each discharge roller pair 25 and each rotary roller 66. At that time, the print sheet P is supported such that the image fixation surface thereof is located at the position of the reference straight line 79. In such a supported state, the image fixation surface does not contact each inner guide rib 76. In this state, the print sheet P is further conveyed in the discharge direction. Accordingly, the image fixation surface of the print sheet P does not contact each inner guide rib 76 after the fixation. Thus, the image fixation surface is prevented from being rubbed against each inner guide rib 76 to cause disturbance of the image. In addition, in the case where the print sheet P having moved past each rotary roller 66 in the discharge direction is conveyed in the reverse direction in a double-sided printing process, when the leading end, in the reverse direction, of the print sheet P advances toward the branch point T1, the end portions, in the width direction, (the sheet end portions) of the print sheet P are gradually lifted by the outer guide ribs 77. Then, the sheet end portions of the print sheet P are lifted to the reference straight line 79 by the portions 77A before each rotary roller 66. Accordingly, the sheet end portions of the print sheet P do not hang down, and hanging-down of the sheet end portions is eliminated. Moreover, since the print sheet P is curved in a mortar shape in the width direction, the stiffness of the entire print sheet P is increased, and the straightness of reverse conveyance in the reverse direction is increased. As a result, when the print sheet P passes through the branch point T1, the sheet end portions of the print sheet P do not enter into the straight path 26D1, and bending or jamming of the sheet end portions is eliminated.

In the above-described embodiment, the configuration in which each outer guide rib 77 is formed in a shape with the same height as the reference straight line 79 has been described as an example, but the present disclosure is not limited thereto. For example, each outer guide rib 77 may be formed in a shape higher than the reference straight line 79. In this case as well, the sheet end portions are lifted, and thus bending or jamming of the sheet end portions of the print sheet P is prevented from occurring when the print sheet P passes through the branch point T1.

In addition, the outer guide ribs 77 in the above-described embodiment may be provided outward of the discharge roller pairs 25 in the width direction (a direction that coincides with the front-rear direction 7) and outward of the rotary rollers 66 in the width direction. In this case, the sheet end portions that are not supported by the rotary rollers 66 are supported at the reference straight line 79 by the outer guide ribs 77. Accordingly, the sheet end portions are lifted to a position higher than the guide surface of the conveyance guide 71. Thus, the sheet end portions of the print sheet P are unlikely to enter into the straight path 26D1 from the branch point T1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a first conveyance path configured to guide a sheet member from a sheet storage portion to an image forming portion;

a second conveyance path formed at a downstream side of the first conveyance path in a conveying direction of the sheet member and configured to guide the sheet member having an image formed thereon by the image forming portion, to a sheet discharge port;

a third conveyance path, one end thereof being connected to the first conveyance path and the other end being connected to the second conveyance path, configured to reverse the sheet member guided to the sheet discharge port and guide the sheet member to the image forming portion;

a merging portion at which the second conveyance path and the third conveyance path merge with each other; and a discharge roller pair provided near the sheet discharge port so as to be rotatable forward and reversely and configured to nip the sheet member and convey the sheet member from the sheet discharge port either in a discharge direction or in a reverse direction, wherein the second conveyance path includes a conveyance guide provided with a plurality of guide ribs that project upward from a guide surface thereof and extend toward a discharge port side along the conveying direction of the sheet member from a same position on a merging portion side, and the plurality of the guide ribs are provided at intervals in a width direction perpendicular to the conveying direction of the sheet member and include a plurality of outer guide ribs provided adjacent to each other outward of the discharge roller pair in the width direction and a plurality of inner guide ribs provided adjacent to each other inward in the width direction, and a height of the plurality of outer guide ribs is higher than a height of the plurality of inner guide ribs and is increased from the sheet discharge port side toward the merging portion side.

2. The sheet conveying device according to claim 1, further comprising a rotator provided rotatably at the merging portion side of the conveyance guide, wherein when a tangent line connecting a nip portion formed by the discharge roller pair to an outer circumferential surface of the rotator is defined as a reference straight line, the height of the plurality of outer guide ribs is equal to or higher than the reference straight line.

3. The sheet conveying device according to claim 1, wherein the conveyance guide includes: an upstream-side guide portion disposed at an upstream side of the merging portion in the conveying direction of the sheet member and extending in an up-down direction; and a downstream-side guide portion disposed at a downstream side of the merging portion in the conveying direction of the sheet member and gently inclined toward the sheet discharge port, and is formed in a curved shape such that the upstream-side guide portion and the downstream-side guide portion are connected to each other, and the guide ribs are provided to the downstream-side guide portion, one roller of the discharge roller pair is provided at the sheet discharge port side of the downstream-side guide portion, and the rotator is provided at the merging portion side of the downstream-side guide portion.

4. The sheet conveying device according to claim 1, wherein a plurality of the discharge roller pairs are provided in the width direction, and the plurality of outer guide ribs are provided outward, in the width direction, of the discharge roller pairs located at both ends in the width direction.

5. The sheet conveying device according to claim 2, wherein the plurality of outer guide ribs are provided outward of the discharge roller pair in the width direction and outward of the rotator in the width direction.

6. The sheet conveying device according to claim 5, wherein the rotator overlaps a part of the discharge roller pair in the width direction when being seen from the conveying direction side of the sheet member.

7. An image forming apparatus comprising the sheet conveying device according to claim 1.

8. A sheet conveying device comprising:

a first conveyance path configured to guide a sheet member from a sheet storage portion to an image forming portion;

a second conveyance path formed at a downstream side of the first conveyance path in a conveying direction of the sheet member and configured to guide the sheet member having an image formed thereon by the image forming portion, to a sheet discharge port;

a third conveyance path, one end thereof being connected to the first conveyance path and the other end being connected to the second conveyance path, configured to reverse the sheet member guided to the sheet discharge port and guide the sheet member to the image forming portion;

a merging portion at which the second conveyance path and the third conveyance path merge with each other; and a plurality of discharge roller pairs provided near the sheet discharge port so as to be rotatable forward and reversely and configured to nip the sheet member and convey the sheet member from the sheet discharge port either in a discharge direction or in a reverse direction, wherein the second conveyance path includes a conveyance guide provided with a plurality of guide ribs that project upward from a guide surface thereof and extend toward a discharge port side along the conveying direction of the sheet member from a same position on a merging portion side, the plurality of discharge roller pairs are provided at intervals in a width direction perpendicular to the conveying direction of the sheet member, and the plurality of the guide ribs are provided at intervals in the width direction and include a plurality of outer guide ribs provided, in alignment, adjacent to each other in each of two regions outside the plurality of discharge roller pairs that are opposite of each other in the width direction and a plurality of inner guide ribs provided in each of a plurality of regions inside each of the plurality of discharge roller pairs in the width direction, and a height of each of the plurality of outer guide ribs is higher than a height of the plurality of inner guide ribs.

* * * * *